US006431974B1

(12) United States Patent
Tetley et al.

(10) Patent No.: US 6,431,974 B1
(45) Date of Patent: Aug. 13, 2002

(54) ACOUSTIC WIND BAND

(75) Inventors: Paul Antony Tetley, Newtown; Charles A. Gans, Harleysville, both of PA (US)

(73) Assignee: Met Pro Corporation, PA (US)

( * ) Notice: Subject to any disclaimer, the term of this patent is extended or adjusted under 35 U.S.C. 154(b) by 0 days.

(21) Appl. No.: 09/537,892

(22) Filed: Mar. 29, 2000

(51) Int. Cl.[7] ..... F23L 17/02
(52) U.S. Cl. ..... 454/33; 454/16
(58) Field of Search ..... 454/15, 16, 33, 454/36

(56) References Cited

U.S. PATENT DOCUMENTS

| | | | | | |
|---|---|---|---|---|---|
| 603,881 | A | * | 5/1898 | Kuphal | 454/33 |
| 2,478,761 | A | * | 8/1949 | Houseman | 454/33 |
| 2,605,693 | A | * | 8/1952 | Hansen | 454/33 |
| 3,115,820 | A | * | 12/1963 | Adelt | 454/33 |
| 3,719,032 | A | * | 3/1973 | Cash | 454/33 |
| 4,184,417 | A | * | 1/1980 | Chancellor | 454/33 |
| 4,806,076 | A | * | 2/1989 | Andrews | 415/209 |
| 5,439,349 | A | * | 8/1995 | Kupferberg | 454/33 |

FOREIGN PATENT DOCUMENTS

| | | | | |
|---|---|---|---|---|
| FR | 77311 | * | 1/1962 | 454/33 |
| GB | 15102 | * | 8/1894 | 454/33 |
| GB | 6121 | * | 3/1897 | 454/33 |
| GB | 507787 A | * | 6/1939 | 454/36 |
| GB | 610153 A | * | 10/1948 | 454/36 |

* cited by examiner

*Primary Examiner*—Harold Joyce
*Assistant Examiner*—Derek S. Boles
(74) *Attorney, Agent, or Firm*—Woodcock Washburn LLP

(57) ABSTRACT

An apparatus, system and method for improving air entrainment and sound attenuation of gases being discharged from one or more outlet portions of an exhausting device using an acoustic wind band. The acoustical wind band helps improve entrainment of ambient environmental air with the exhaust gases being discharged from the exhausting device resulting in a tight plume of high velocity flow which improves the effective stack height of the exhausting device. This is achieved by positioning the sections of the acoustical wind band in spaced relation thus forming passages that allow outside ambient environmental air to flow into the acoustical wind band to mix with and dilute the exhausting gas. The sections may also be positioned extending upward and inward at an angle to further enhance the entrainment of ambient environmental air with the flow of exhaust gas from the gas exhaust device. The acoustical wind band also helps to block noise, especially line of sight noise, from the outlet of the exhausting device thereby improving sound attenuation. This may be achieved by having at least a portion of the bottom end of a lowest most section extend into the horizontal plane defined by the line of sight and having at least a portion of the top end and the bottom end of adjacent sections be coplanar, or preferably overlap, one another to block noise generated by the exhaust device or exhaust gas at the discharge from directly exiting the wind band. In addition, the acoustical wind band helps to protect the vena contracta produced by the converging flow (plume)of exhaust gas from environmental conditions, such as for example, wind shear.

33 Claims, 9 Drawing Sheets

ACOUSTIC WIND BAND

FIELD OF THE INVENTION

The present invention relates in general to a gas exhaust system, and particularly, the present invention relates to an acoustical wind band for use with an exhaust device for exhausting gas from, for example, the interior of a building. The invention is especially useful in improving the entrainment of environmental air into the exhaust fume thereby improving the discharge velocity of the exhaust gas and therefore the effective stack height of the exhaust device and also in improving the sound attenuation of noise from the exhaust device or exhaust device outlet.

BACKGROUND OF THE INVENTION

Conventional exhaust systems are typically manufactured having a fan and a nozzle device for pulling a gas out of the interior of a building and then increasing the velocity of the exiting air in order to properly dispel the air and also to avoid re-entrainment of the discharged air. In this regard, reference is made to U.S. Pat. No. 4,806,076, issued to Andrews, and U.S. Pat. No. 5,439,349, issued to Kupferberg, which are designed to provide a high velocity jet for exhausting atmosphere and other gases. These exhaust fans are typically mounted on the roof areas of buildings and are used to carry exhaust gases as high as possible above the roof line of the building so as to ensure an effective final dilution of the gases within the greatest possible volume of ambient air and to ensure their dispersal over a large area with maximum dilution.

For example, the radial upblast exhaust fan apparatus described and shown in U.S. Pat. No. 4,806,076 has a nozzle in which two converging flow paths are defined by two respective passageways. A fan means is positioned within the fan housing to urge exhaust gases to flow upwardly through the exhaust paths. A passive zone located between the two flow paths supplies environmental air for mixing by induction into the contaminated gases being exhausted through the converging flow paths.

In addition, prior art devices for exhausting gases to atmosphere can have a wind band, or annular ring, that may be positioned vertically extending in general parallel relationship with respect to an upper end of the fan or nozzle housing in order to facilitate mixing of the exhausted gas with ambient environmental air. For example, a wind band can be provided at one end of the two passages at the outlets of the radial upblast exhaust fan apparatus described and shown in U.S. Pat. No. 4,806,076, to provide an entrainment of fresh air to mix with and dilute the gases exhausting from the two passageways. Another conventional wind band is shown and described in U.S. Pat. No. 5,439,349, which describes a ring defining an annulus provided at the outlet end of a bifurcated stack to induce ambient air to mix with the spent air exhausting from the bifurcated tubular member.

Typically, the wind band is located in spaced relation with respect to an outer wall of the fan or nozzle housing by, for example, a wind band bracket means. In this manner, when gases are exhausted through the discharge of the exhausting device, ambient environmental air will be introduced between the space, formed between the outer wall of the exhausting device and the side wall of the wind band, and mix with and dilute the exhausting gases. However, conventional wind bands are limited in the amount of entrainment that they can achieve due to their design and construction.

In addition, conventional exhaust fans for moving large volumes of air often generate high levels of noise which is undesirable. As a result, a wide variety of fan silencing equipment has been proposed to absorb fan noise, thereby reducing fan noise to an acceptable level. However, conventional silencers are typically used at the fan portion of the device, and thus do not control noise at the nozzle or outlet portion. These conventional silencers are undesirable for several reasons, including because they lead to an increase in the overall height of the fan device and they are limited to a relatively low air distribution velocity (on the order of less than about 3000 feet per minute) in which they are effective (e.g., provide maximum attenuation without themselves generating any significant additional noise).

One conventional exhaust system that attempts to reduce fan noise at the nozzle or outlet portion to an acceptable level is pending U.S. patent application entitled "Acoustic Silencer Nozzle", Ser. No. 09/390,796, filed Sep. 7, 1999, which describes a high velocity silencer nozzle for reducing the amount of noise generated by the exhausting gases as they exit through the exhausting device. The acoustic silencer nozzle provides acoustically absorbing media or resonating chambers adjacent the converging exhaust paths of the nozzle. In this manner, the noise at the nozzle or outlet portion is reduced and a tighter plume of high discharge flow is achieved. However, these conventional silencers are limited in their ability to block noise, such as line of sight noise, from the exhausting gas at the outlet portion or portions of the exhaust device.

Therefore, a need exists for a device that improves the entrainment of ambient environmental air with the exhausting gases and also that improves sound attenuation of the discharging gases at the outlet portion of the fan, nozzle, stack, silencer, ducting, or the like, while still maintaining a relatively low height of the exhausting device and providing a relatively high air distribution velocity, without adding significantly to system pressure.

SUMMARY OF THE INVENTION

The present invention is directed to an apparatus, system, and method for improving the entrainment of ambient environmental air with the exhaust gas passing through the acoustical wind band and for improving the attenuation of sound from the exhaust gas exiting the exhaust device. The acoustic wind band apparatus can be used with a gas exhaust device having a discharge outlet portion for exhausting gas in a gas exhaust system. The acoustical wind band includes a plurality of spaced apart wind band sections, each wind band section having a top end defining a top opening, a bottom end defining a bottom opening, and one or more side walls disposed between and connecting the top end to the bottom end. The plurality of wind band sections are disposed circumferentially and in vertical spaced relation over the discharge outlet portion of the gas exhaust device and extending generally upward therefrom.

The acoustic wind band apparatus includes a plurality of passages formed around a peripheral of the acoustical wind band and disposed circumferentially about the discharge outlet portion. Each passage draws a flow of gas from environmental atmosphere outside the acoustical wind band to induce a flow of environmental gas from therebelow to mix with and dilute gas from the discharge outlet portion inside the acoustical wind band. The number of the plurality of passages corresponds to a number of the plurality of wind band sections. The acoustic wind band includes at least a first passage formed between one of a top wall and a side wall of the exhaust device and the side wall of the lower most wind band section and at least a second passage formed between a second wind band section side wall and the first wind band side wall.

Each sections can include one of a cylindrical shape, a straight conical shape, a curved conical shape, a square shape, and a rectangular shape. The bottom opening and the top opening can comprise one of a circular shape, a square shape, and a rectangular shape. Preferably, the side walls of adjacent sections of the plurality of wind band sections are parallel with respect to one another. Each wind band section has a smallest diameter or width greater than a diameter or width of the discharge outlet portion.

Preferably, the first, lowest most, wind band section is positioned over and about the discharge portion and each vertically successive section is larger than the preceding section and each vertically successive section is positioned over and about the preceding section. Alternatively, the first, lowest most, wind band section can be positioned over and about the discharge portion and each vertically successive section can be smaller than the preceding section and each vertically successive section can be positioned over and within the preceding section.

The acoustic wind band apparatus includes support structures disposed between and connection the acoustical wind band to the exhaust device. The support structures also hold the plurality of wind band sections in spaced apart relation with respect to one another.

The acoustical wind band can be constructed to improve sound attenuation of the exhaust gas exiting the exhaust device. For example, the bottom end of the first, lowest most, wind band section preferably extends at least to a horizontal plane defined by a line of sight of the discharge outlet portion and the bottom end each vertically successive wind band section preferably extends at least to a horizontal plane defined by the top end of a vertically preceding wind band section.

A further embodiment within the scope of the present invention is directed to a system that improves the entrainment of ambient environmental air with the exhausting gases and also that improves sound attenuation of noise generated by the exhaust device or by the discharging gases at the outlet portion of the device. The system includes an exhaust device and an acoustical wind band. The exhaust device can include any conventional exhaust device, including for example, a fan, a nozzle, a stack, a silencer, ducting, piping, or the like. A gas movement device is provided as part of, or separately from the gas exhaust device. A drive mechanism, such as an electric motor, is provided to generate a flow of exhaust gas through the exhaust device. The drive mechanism can be directly coupled to the gas movement device, or may be indirectly coupled to the gas movement device through, for example mechanical linkage or belt and pulley arrangement.

In one embodiment of the present invention, the exhaust device can include a radial upblast, mixed flow, centrifugal, or axial exhaust fan, including a main housing having a fan housing in the lower section thereof and acoustic silencer nozzle positioned above the fan housing and extending upwardly therefrom. The exhaust device can include one or more vertical flow paths and thus one or more upper contaminated air outlets.

In another embodiment of the present invention, the exhaust device can include an exhaust fan apparatus, such as a centrifugal fan scrolling casing, with a centrifugal fan impeller mounted on an axle within the casing and having an axis of rotation at right angels to the side members of the scroll casing. In operation, the impeller, driven by motor, draws an exhaust gases from a building containing airborne contaminants through duct and then upwardly into the stack or nozzle by first passing through a diffuser and then double passageways.

The acoustical wind band apparatus is positioned circumferentially around and in vertical spaced relation over the discharge outlet portion of the gas exhaust device and extending generally upward therefrom. The acoustical wind band includes a plurality of passages formed around a peripheral of the acoustical wind band and disposed circumferentially about the discharge outlet portion. Each passage draws a flow of gas from environmental atmosphere outside the acoustical wind band to induce a flow of environmental gas from therebelow to mix with and dilute gas from the discharge outlet portion inside the acoustical wind band. A flow of fluid exiting one or more exhaust flow paths and passing through the acoustical wind band sets up aspiration in such a manner so that the further flow of fluid is drawn from ambient atmosphere through the passages. The acoustical wind band can be constructed to improve sound attenuation by blocking a direct line of sight of noise generated to the exhausting gas. Preferably, a bottom end of a first, lowest most, wind band section extends at least to a horizontal plane defined by a line of sight of the discharge outlet portion and the bottom end each vertically successive wind band section extends at least to a horizontal plane defined by a top end of a vertically preceding wind band section.

A further embodiment within the scope of the present invention is directed to a method for improving the entrainment of ambient environmental air with the exhausting gases, while still maintaining a relatively low height of the exhausting device, thus providing a relatively high air distribution velocity, without adding significantly to system pressure. The method includes providing a gas exhaust device having a gas inlet opening for receiving a gas to be exhausted and a gas outlet opening for discharging the gas to atmosphere, disposing an acoustic wind band having a plurality of vertically spaced apart wind band sections over and about the exhaust gas outlet of the exhaust device, forming a plurality of passages for drawing ambient environmental air from a point outside the acoustical wind band to a point inside the acoustical wind band, wherein a number of the plurality of passages corresponds to a number of the plurality of wind band sections, and wherein a first passage is formed between a housing of the gas exhaust device and an inner surface of the lower wind band section and each successive passage is formed between an outer surface of a preceding wind band section and an inner surface of a successive wind band section, and inducing a plurality of flows of ambient environmental air through the plurality of passages to be mixed with and dilute the exhaust gas discharging from the exhaust device discharge.

According to another aspect of the invention, the method includes forming each of the wind band sections extending upward and inward to form an angle inclined toward an upper, center region of the acoustical wind band. The angles act to increase one or more of a velocity and a volume of the exhaust gas flowing through the acoustical wind band.

A further embodiment within the scope of the present invention is directed to a method for improving sound attenuation in a gas exhaust system, such as a fan, nozzle, stack, silencer, ducting, piping, or the like. The method includes providing a gas exhaust device having a gas inlet opening for receiving a gas to be exhausted and a gas outlet opening for discharging the gas to atmosphere, disposing an acoustic wind band having a plurality of vertically spaced apart wind band sections over and about the exhaust gas outlet of the exhaust device, positioning a first, lower wind band section such that at least a portion of a bottom end of the lower wind band section blocks a direct line of sight from a point outside the exhaust device and the lower wind band section from a point inside the exhaust device and the lower wind band section, positioning each vertically successive wind band section such that at least a portion of a bottom end of a vertically successive wind band section blocks a direct line of sight from a point outside a vertically preceding wind band section and the successive wind band section from a point inside the preceding wind band section and the successive wind band section, and blocking noise generated by the exhaust device and the exhaust gas outlet opening from radiating along a direct line of sight from a point inside the acoustical wind band and the exhaust device to a point outside the acoustical wind band and the exhaust device.

According to another aspect of the invention, the method includes forming each of the wind band sections extending upward and inward to form an angle inclined toward an upper, center region of the acoustical wind band. The angles act to reflect noise inward and upward through the acoustical wind band thereby improving sound attention.

BRIEF DESCRIPTION OF THE DRAWINGS

The foregoing and other aspects of the present invention will become apparent from the following detailed description of the invention when considered in conjunction with the accompanying drawings. For the purpose of illustrating the invention, there is shown in the drawings embodiments that are presently preferred, it being understood, however, that the invention is not limited to the specific methods and instrumentalities disclosed. In the drawings.

DETAILED DESCRIPTION OF PREFERRED EMBODIMENTS

Figure 1:
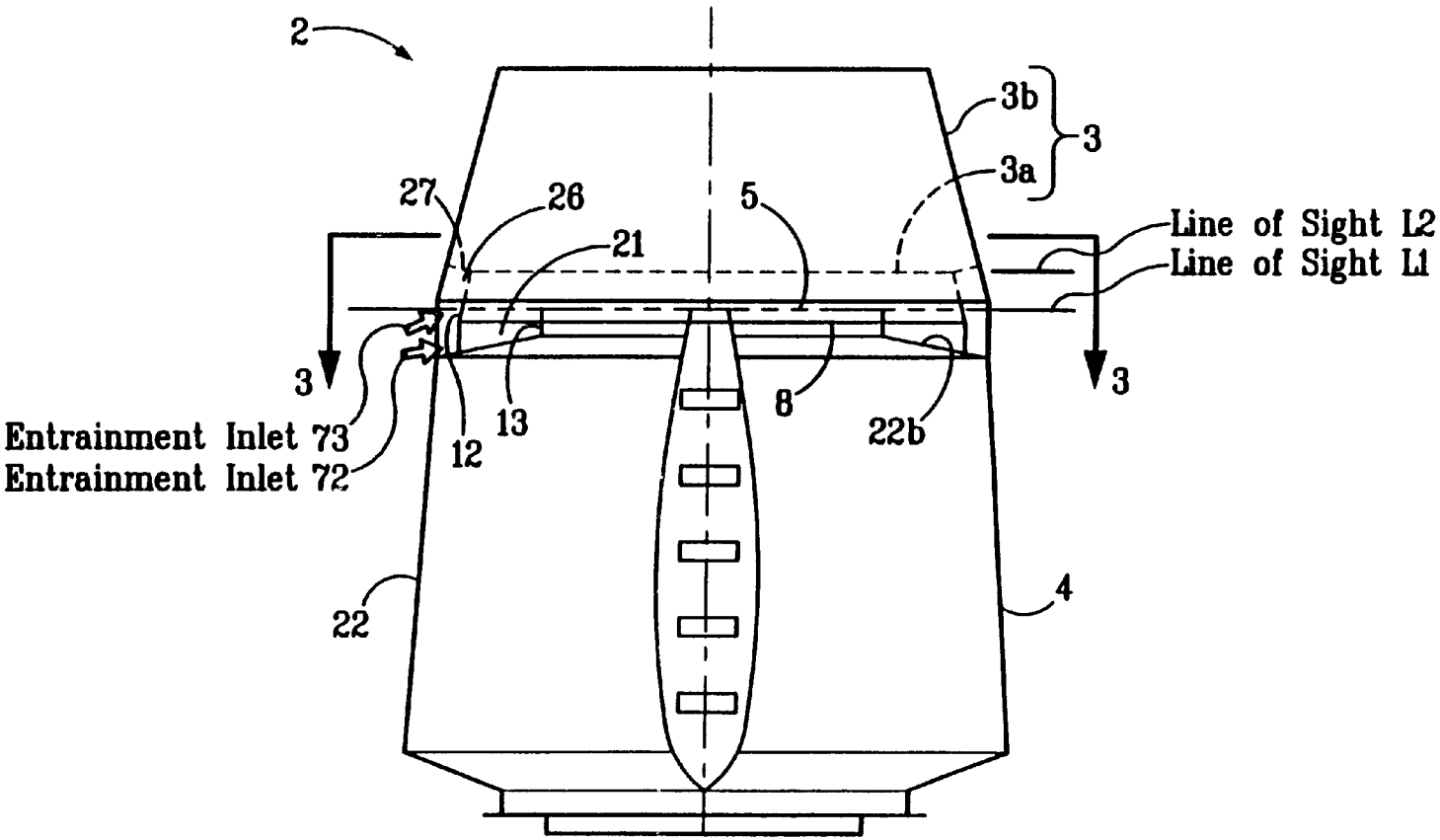
FIG. 1 is a plan view of an exemplary gas exhaust system having an acoustic wind band in accordance with the present invention.

The present invention is directed to an apparatus, system, and method for optimizing air entrainment and sound attenuation of gases being discharged from one or more outlet portions of a gas exhaust device using an acoustic wind band. The acoustical wind band of the present invention helps improve entrainment of ambient environmental air with the exhaust gases being discharged from the exhausting device resulting in a tight plume of high velocity flow which improves the effective stack height of the exhausting device. The acoustical wind band also helps to block line of sight noise from the outlet of the exhausting device thereby improving sound attenuation. In addition, the acoustical wind band can help to protect the vena contracta produced by the converging flow (plume) of exhaust gas from environmental conditions, such as for example, wind shear.

As shown in the Figures, the acoustical wind band 2 includes two or more sections 3 disposed concentrically over and about the discharge of the exhausting device 4 and in spaced relation to the outlet portion 5 of the exhaust device 4 and in spaced relation with any adjacent sections 3. The sections 3 may have a cylindrical shape, a square shape, a rectangle shape, or preferably, the sections have a conical shape. Each section 3 has a smallest width or diameter greater than the width or diameter of the discharge opening 5 of the exhausting device 4 to allow proper discharge of the exhaust gas from the device. The sections 3 are positioned in vertical, spaced succession, preferably with each successive section being larger (having a greater cross-sectional width or diameter) than the preceding section and being disposed over and about the preceding section. Alternatively, each successive section can be smaller (having a lesser cross-sectional width or diameter) than the preceding section and being disposed over and within the preceding section.

A passageway is formed between each vertically successive sections to provide a pathway for the entrainment of ambient environmental air from outside the acoustical wind band with the exhaust gas being discharged inside the acoustical wind band by the exhausting device. Preferably, at least a portion of the top end and the bottom end of adjacent sections are coplanar, or preferably overlap, one another to block noise generated by the exhaust device or exhaust gas at the discharge from directly exiting the wind band.

FIG. 1 shows an exemplary acoustical wind band 2 in accordance with the present invention mounted to an exemplary exhausting device 4. As shown in FIG. 1, the acoustical wind band 2 can include two conical-shaped sections 3 (hereinafter also referred to as a lower cone 3*a* and an upper cone 3*b*) positioned concentrically about a discharge opening 5 of an exhausting device 4. The inner cone 3*a* is positioned over and about the discharge outlet portion or portions 5 of the exhausting device 4. The outer cone 3*b*, preferably being larger than the preceding inner cone 3*a*, is positioned over and about the inner cone 3*a*. The sections 3 may be positioned extending generally vertically in general parallel relationship with respect to an upper discharge end 5 of the exhausting device 4.

Figure 2:
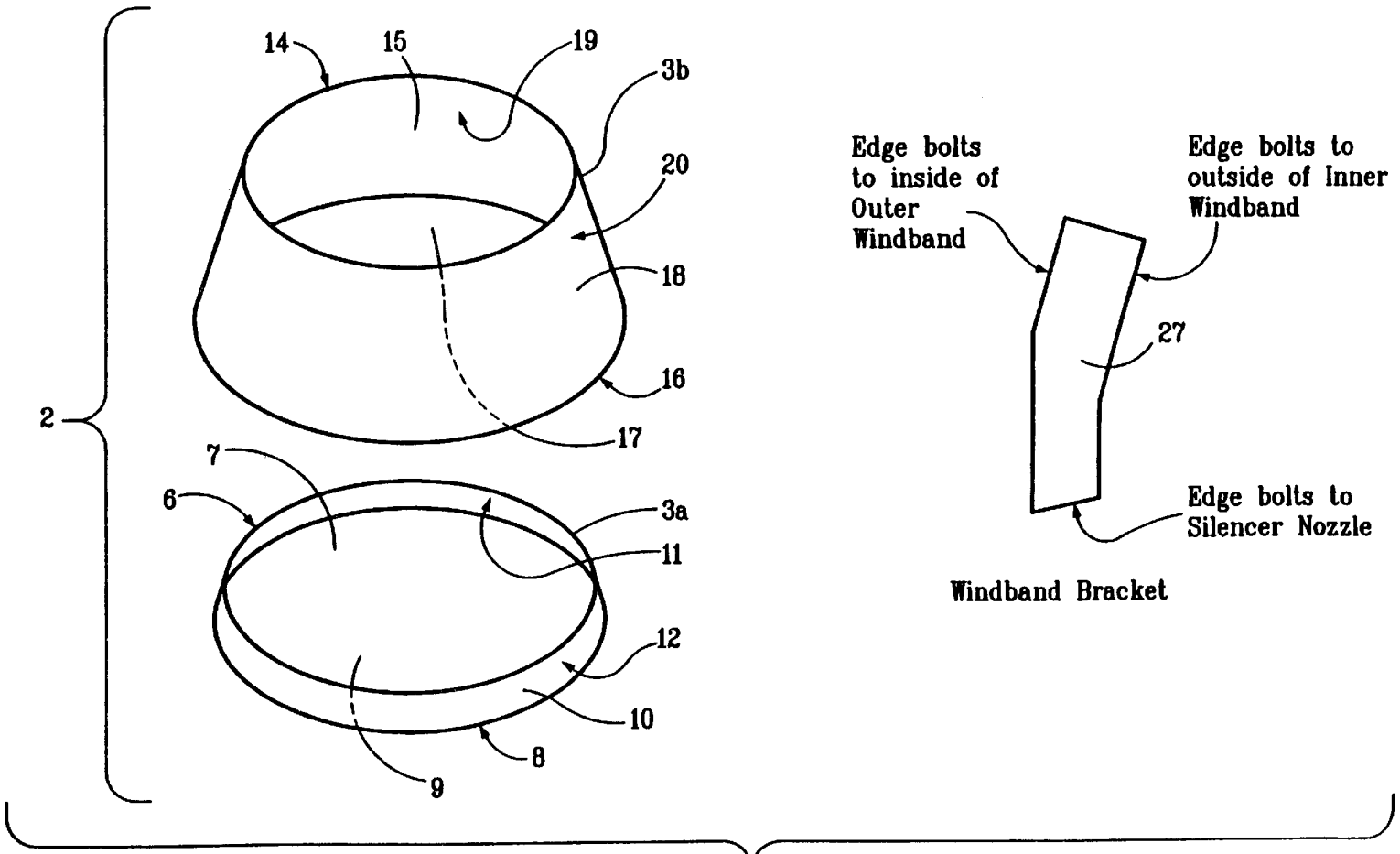
FIG. 2 is an exploded view of the exemplary gas exhaust system of FIG. 1.

FIG. 2 shows an exploded view of the exemplary acoustical wind band 2 of FIG. 1, having a lower, inner conical section 3*a* and an upper, outer conical section 3*b*. As shown in FIG. 2, the lower section 3*a* includes a top end 6 defining a top opening 7, a bottom end 8 defining a bottom opening 9, and at least one side wall 10 disposed between and connecting the top end 6 to the bottom end 8. Each lower section 3*a* side wall 10 includes an inner surface 11 and an outer surface 12. As shown, the top opening 7 and the bottom opening 9 of the lower section have a circular shape.

Figure 4:
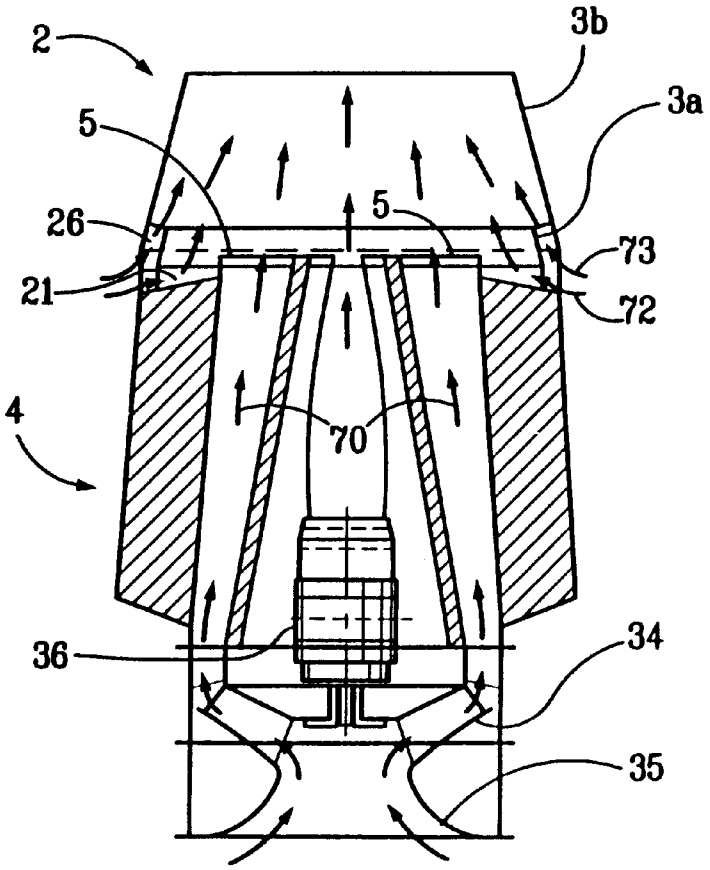
FIG. 4 is a cross sectional view of the gas exhaust system of FIG. 1 taken long line B—B.
Figure 5:
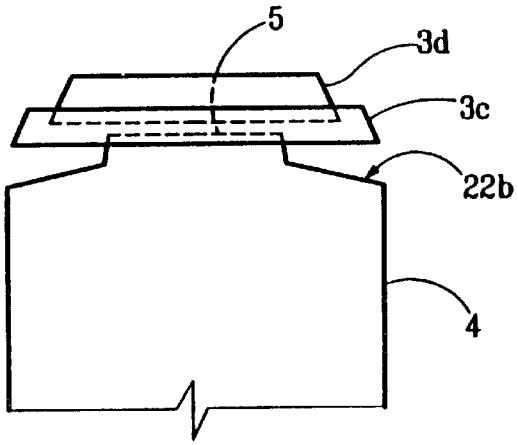
FIG. 5 is a plan view of another exemplary acoustic windband in accordance with the present invention.
Figure 6:
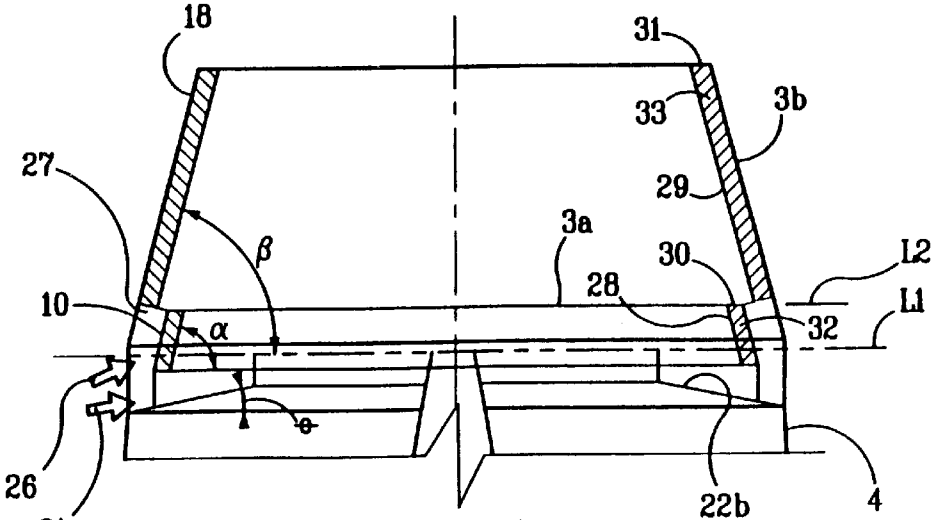
FIG. 6 is a plan view of another exemplary gas exhaust system having an acoustic wind band in accordance with the present invention.
Figure 9:
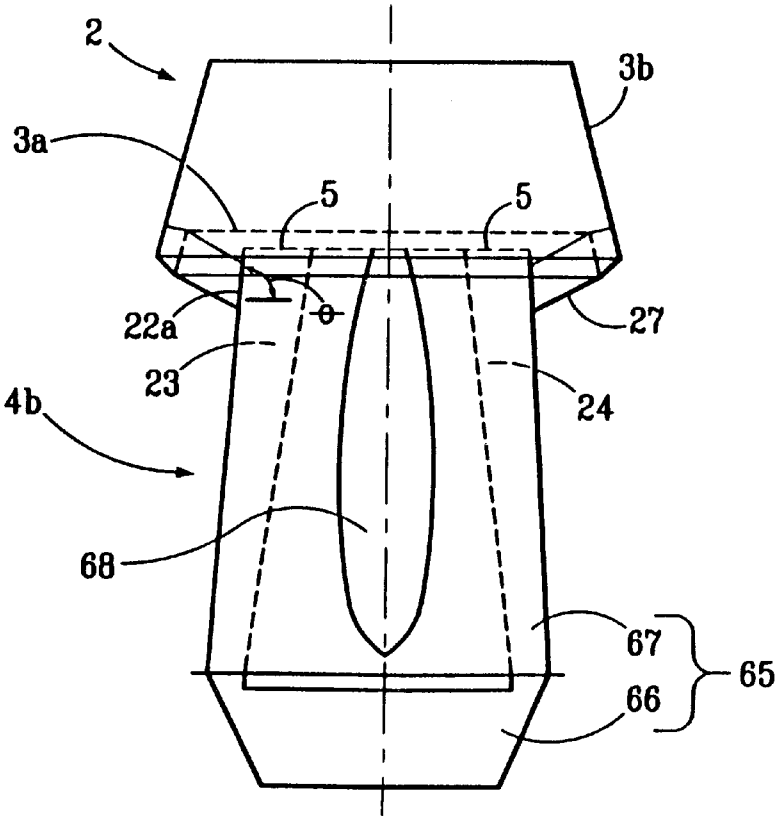
FIG. 9 shows another exemplary embodiment wherein the acoustical wind band is disposed circumferentially and in spaced relation about one or more discharge outlets of an exhaust fan apparatus, such as a radial upblast, mixed flow, centrifugal or axial exhaust fan.
Figure 11:
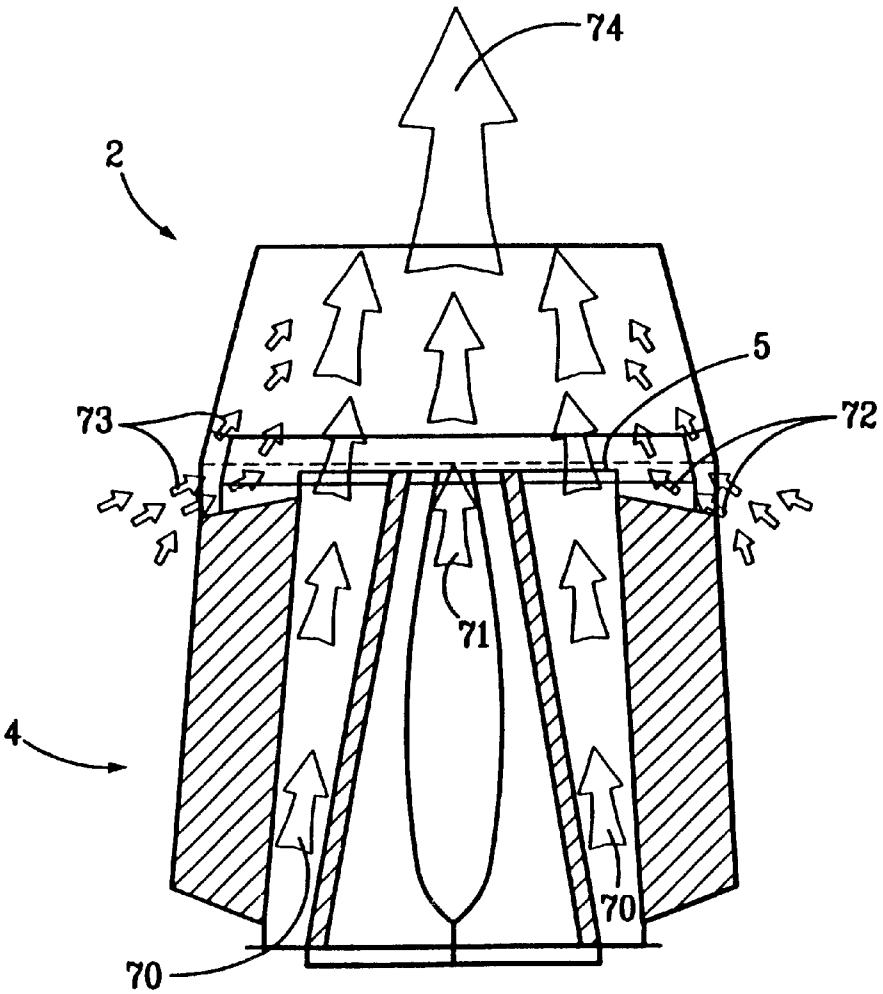
FIG. 11 is a schematic view of the gas exhaust system of FIG. 1 showing exemplary exhaust gas and entrainment air flows through the acoustical wind band.

As shown in FIGS. 1, 3, 4, 5, 6, 7, and 9, the acoustic wind band apparatus 2 includes a first passage 21 formed between the lower section 3*a* and a housing 22 of the gas exhaust device 4. Preferably, the first passage 21 is defined by the inner surface 11 of the lower section 3*a* and one or more of a side wall 22*a*, as shown in FIGS. 7 and 9, and a top wall 22*b*, as shown in FIGS. 1 and 6, of the gas exhaust device housing 22. The movement of the primary exhaust stream of fluid, as represented by arrow 70 in FIGS. 4 and 11, sets up aspiration in such a manner so that one or more secondary streams of fluid, as represented by arrows 72 of FIGS. 1, 4, and 11, are drawn from the ambient fluid of the atmosphere. In this manner, the first passage 21 draws a first flow of gas 72 from environmental atmosphere to induce a flow of environmental gas from therebelow, to mix with and dilute exhaust gas exiting from the discharge outlet portions 5 of the exhaust device 4.

As shown, the acoustical wind band 2 includes at least a second passage 26 formed between the lower section 3*a* and the upper section 3*b*. Preferably, the second passage 26 is defined by the inner surface 19 of the upper section 3*b* and the outer surface 12 of the lower section 3*a*. The movement of the primary exhaust stream of fluid 70 sets up aspiration in such a manner so that one or more secondary streams of fluid, as represented by arrow 73 of FIGS. 1, 4, and 11, are drawn from the ambient fluid of the atmosphere. In this manner, the second passage 26 draws a second flow of gas 73 from environmental atmosphere to induce a further flow of environmental gas from therebelow to further mix with and dilute gas from the one or more discharge outlets 5 of the exhaust device 4.

In an alternate embodiment (not shown) having three sections, a third passage would be formed between the second and the third sections, in another alternate embodiment (not shown) having four sections, a fourth passage would be formed between the third and the fourth sections, etc. Each addition section helps form an additional passage for the entrainment of ambient environmental air from therebelow with the main stream of exhausting gas. The number of sections is dependent on the particular application and the desired system operating characteristics, including entrainment properties, actual and effective stack height, discharge velocity, dilution and distribution of the exhaust gas, etc.

As shown in FIGS. 1, 3, 4, and 5, the lower section 3*a* is disposed circumferentially and in spaced relation about one or more discharge outlet portions 5 of a gas exhaust device 4 and extends generally upward therefrom. As shown in FIG. 1, the bottom end 8 of the lower section 3*a* preferably extends at least to a plane defined by the one or more discharge outlets 5 of the exhausting device 4 (e.g., they are coplanar), and more preferably, overlap one another (e.g., the bottom end 8 of the lower section 3*a* extends below a horizontal plane defined by an uppermost point of the discharge 5 of the exhaust device 4). For example, the bottom end 8 of the lower section 3*a* is positioned relative to an upper most portion of a discharge outlet 5 of the exhausting device 4 such that the direct line of sight L1 from a point outside the exhausting device 4 and acoustical wind band 2, does not reach a point along the direct line of sight inside the exhausting device 4 and acoustical wind band 2. Consequently, a barrier is provided so that no free path is available by which sound waves (e.g., noise) originating within the exhausting device 4 or at the discharge outlet 5 can travel directly to points outside the exhausting device 4. Accordingly, the only surfaces visible from outside the exhausting device 4 and acoustical wind band 2 are an outer surface 13 of the exhausting device 4 and/or the outer surface 12 of the lower section 3*a*. This feature provides sound attenuation of line of sight noise.

Also, FIG. 2 shows an exemplary upper section 3*b* having a top end 14 defining a top opening 15, a bottom end 16 defining a bottom opening 17, and at least one side wall 18 disposed between and connecting the top end 14 to the bottom end 16. The upper section 3*b* side wall 18 includes an inner surface 19 and an outer surface 20. As shown, the vertically successive upper section 3*b* is larger than the preceding lower section 3*a*. As shown, the top opening 15 and the bottom opening 17 of the upper section 3*b* have a circular shape.

As shown in FIG. 1, the upper section 3*b* is disposed circumferentially and in spaced relation about the lower section 3 a and extends generally upward therefrom. The bottom end 16 of the upper section 3*b* preferably extends at least to a plane defined by the top end 6 of the lower section 3*a* (e.g., they are at least coplanar), and more preferably, they overlap one another (e.g., the bottom end 16 of the upper section 3*b* extends below a horizontal plane defined by the top end 6 of the lower section 3*a*). For example, as shown in FIG. 1, the bottom end 16 of the upper section 3*b* is positioned relative to an upper most portion of the top end 6 of the lower section 3*a* such that the direct line of sight L2 from a point outside the acoustical wind band 2, does not reach a point along the direct line of sight inside the acoustical wind band 2. Consequently, a barrier is provided so that no free path is available by which sound waves (e.g., noise) originating within the exhausting device 4 or at the discharge outlet 5 can travel directly to points outside the acoustical wind band 2. Accordingly, the only surfaces visible from outside the exhausting device 4 and acoustical wind band 2 are the outer surfaces 20 of the upper section 3*b* and/or the outer surface 12 of the lower section 3*a*. This feature provides sound attenuation of line of sight noise.

In alternative embodiments (not shown), the acoustical wind band may have three sections, four sections, five sections, etc. Preferably, each vertically successive section is constructed and positioned relative to the preceding section as described above with respect to an acoustical wind band having two sections.

Alternatively, as shown in FIG. 5, the lower section 3*c* can have a width or diameter larger than the width or diameter of the vertically successive, or upper section 3*d*. Again, each section 3 has a smallest width or diameter greater than the width or diameter of the discharge opening 5 of the exhausting device 4 to allow proper discharge of the exhaust gas from the device. As shown in FIG. 5, the sections 3 can be positioned in vertical, spaced succession, preferably with each successive section 3*d* being smaller (having a smaller cross-sectional width or diameter) than the preceding section 3*c* and being disposed over and within the preceding section 3*c*.

As shown in FIG. 5, at least a portion of the top end and the bottom end of adjacent sections can be coplanar, or preferably overlap, one another to block noise generated by the exhaust device or exhaust gas at the discharge from directly exiting the wind band. Passages are formed between the housing of the exhaust device and between each vertically successive sections to provide a pathway for the entrainment of ambient environmental air from outside the acoustical wind band with the exhaust gas being discharged inside the acoustical wind band by the exhausting device.

The side wall 10 of the lower section 3*a* and the side wall 18 of the upper section 3*b* may extend upward substantially vertically, thus forming a cylindrical section, upward and inward having a curved surface thereby forming bell-shaped sections, or preferably, the side walls 10,18 extend upward and inward substantially in a straight line toward the center of the acoustical wind band 2 thereby forming conical shaped sections, as shown in the Figures.

As shown in FIG. 6, the conical shaped sections 3*a*, 3*b* can include a first angle θ formed by one of a top wall 22*b* and a side wall 22*a* of the gas exhaust device 4 from the horizontal. The first angle θ helps to maximize or improve air entrainment and sound attenuation properties of the exhausting gas. For example, as shown in FIGS. 1 and 6, the first angle θ can be formed between a top wall 22*b* of the exhaust device housing 22 and horizontal. As shown in the embodiment of FIGS. 1 and 6, the first angle θ can be about 10 degrees to about 30 degrees. In other exemplary embodiments shown in FIGS. 9, and 10, the first angle θ can be formed by the side wall 22*a* of the exhaust device housing 22 and the horizontal. As shown in the embodiment of FIG. 9, the first angle θ can be about 70 degrees to about 85 degrees. Preferably, the one or more side wall 10 of the lower section 3*a* extend generally upward and inward from the bottom end 8 to the top end 6 to form a second angle α from the horizontal. The second angle α is formed between a horizontal plane defined by the bottom end 8 of the lower section 3*a* and the lower section side wall 10.

Preferably, the side wall 18 of the upper section 3*b* extends generally upward and inward from the bottom end 16 to the top end 14 to form a third angle β from the horizontal. The third angle β is formed between a horizontal plane defined by the bottom end 16 of the upper section 3*b* and the upper section side wall 18.

Preferably, the second angle α and the third angle β are formed depending on the particular application in order to maximize air entrainment and sound attenuation properties of the acoustical wind band 2. For example, the second angle and the third angle are preferably formed as acoustically reflecting angled sections to reflect noise inward and upward to improve sound attenuation, and the angles also help to increase a velocity of the ambient environmental air entering the acoustical wind band. More preferably, the second angle α and the third angle β are formed at an angle between about 60 degrees and about 90 degrees from the horizontal from inside of the wind band 2.

The upper section 3*b* and the lower section 3*a* may have a second and a third angle that are different from one another (e.g., they are not parallel), or preferably, the second and a third angles α, β are the same (e.g., the lower section side wall 10 and the upper section side wall 18 are parallel). The angles are preferably predetermined based on the particular application in order to maximize entrainment by accelerating ambient environmental air with increasing velocity due to the angles.

Again, in an alternate embodiment (not shown) having three sections, a fourth angle would be formed by the third section, in another alternate embodiment (not shown) having four sections, a fifth angle would be formed by the fourth section, etc. Each addition section results in an additional angle for increasing the velocity of the ambient environmental air for entrainment with the exhausting gas. The number of sections and the angle of each section is dependent on the particular application and the desired operating characteristics, including, for example, entrainment properties, actual and effective stack height, discharge velocity, dilution and distribution of the exhaust gas, etc.

The acoustical wind band is designed and constructed so as not to interfere or disrupt the flow of the exhaust gas. For example, the height and angle of the side walls of the acoustical wind band are preferably constructed so as not to interfere or disrupt the flow of exhaust gases exiting the exhaust device and flowing through the acoustical wind band. Each wind band section preferably has a smallest diameter or width greater than a diameter or width of the discharge outlet portion of the exhaust device (e.g., as shown in the Figures, the top end of the upper most section does not interfere with the exhaust gas flow).

In addition, the overall height of the acoustical wind band is preferably kept to a minimum while still achieving desired operating properties. For example, the vertical height of the lower section side wall 10 and the upper section side wall 18 can be designed and constructed to keep the actual stack height of the exhaust device 4 and acoustical wind band 2 to a minimum height while still providing adequate entrainment and velocities of the exhaust gas discharge plume to provide adequate dilution and distribution of the exhaust gas and to avoid re-entrainment of the exhaust gases. Preferably, each vertically successive section 3*b* has a height greater than the preceding section 3*a*.

The acoustical wind band includes support structures 27 for connecting the acoustical wind band 2 to the exhaust device 4 and for holding the individual wind band sections 3 of the acoustical wind band 2 in spaced apart relation with respect to the exhaust device 4 and with respect to one another. The support structure 27 can include any conventional supporting techniques, including brackets, bolts, spacers, arms, or the like, for holding the acoustical wind band 2 in position over the exhaust device 4 and about the outlet portion 5 of the exhaust device 4, and for holding adjacent sections 3*a*, 3*b* in vertical spaced relation.

Figure 3:
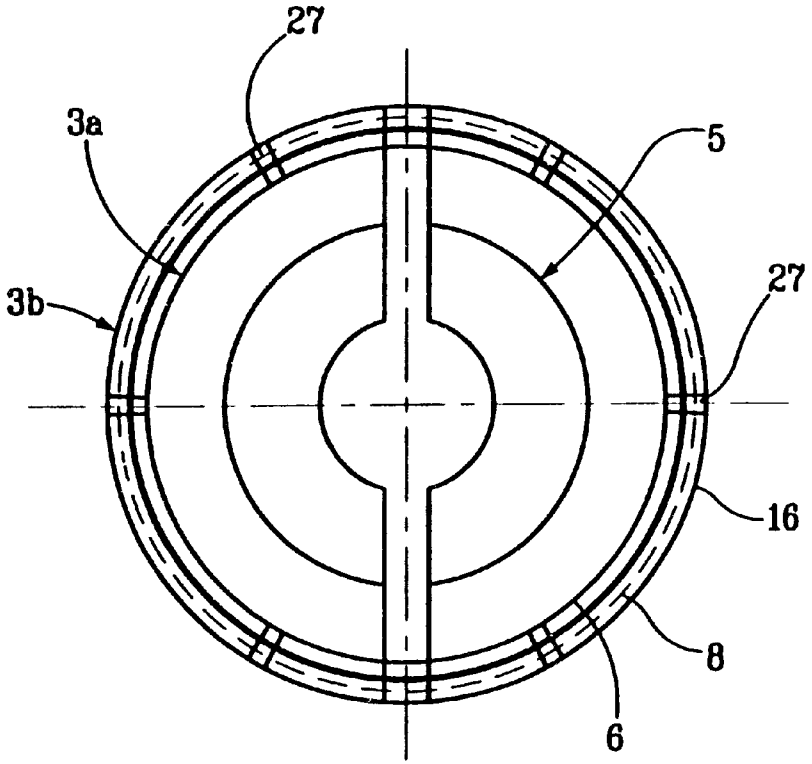
FIG. 3 is a cross sectional view of the gas exhaust system of FIG. 1 taken long line A—A.

As shown in FIGS. 1, 3 and 6, one suitable mounting structure includes a plurality of wind band brackets 27. Preferably, at least three wind band brackets 27, and more preferably six wind band brackets 27 are used and are spaced at equal distances around the peripheral of the acoustical wind band 2, as shown in FIG. 6. The wind band brackets 27 are used to support the acoustical wind band 2 in spaced relation on the exhaust device 4 and to hold the wind band sections 3*a*,3*b* in spaced relation with respect to adjacent sections. Alternatively, separate support structures (not shown) can be provided, one to connect the acoustical wind band to the exhaust device and another to connect the wind band sections together.

The acoustical wind band 2 can be manufactured in one or more pieces and may be cut, molded and formed into shape. For example, the acoustical wind band can be made from metallic sheets, such as steel or aluminum, that are cut into sections and formed into shape and can be coupled together using conventional fasteners or welding techniques. In addition, the acoustical wind band can be manufactured by cast or injection molding. The acoustical wind band can be made from any conventional material that is suited for use on, for example a rooftop, and that can withstand normal environmental conditions, such as hot, cold, dry, wet, and windy weather, and that can also withstand typical discharge velocities and exhaust gases that may be discharged through the wind band by the exhaust device. For example, the wind band material can be metallic, fiberglass, polypropylene, or the like.

In addition, the inner surfaces 11,19 and the outer surfaces 12,20 of one or more of the sections 3*a*,3*b* can include a sound reflecting and/or sound absorbing material, as shown in FIG. 6. All or a portion of the inner surface and/or the outer surface of one or more of the sections may include a perforated material, such as perforated steel, fiberglass, or polypropylene. For example, as shown in FIG. 6, the inner surfaces 11,19 of each of the sections 3*a*,3*b* can include a sound reflecting and/or sound absorbing material. As shown, a first and second inner sheaths 28,29 may be disposed adjacent all or a portion of the inner surfaces 11,19 of the side walls 10,18 of the lower and upper sections 3*a*,3*b*, respectively. The inner sheaths 28,29 can include perforated pieces and can have respective partitions spaced therebetween, thus providing respective inner enclosed spaces or chambers 30,31. The inner enclosed spaces can have disposed therein an acoustic absorbing material 32,33, such as plastic, coated or galvanized steel, stainless steel, mineral wool, or a fiberglass material, or any acoustically treated media. The sections may also include a chemical resistant wrap or barrier (not shown) such as mylar, polyurethane, or similar material to prevent exhaust pollutants, moisture, or mold from accumulating in the acoustical material or cavity. Alternatively, the inner enclosed spaces 30,31 can each be a resonating chamber. The inner enclosed spaces or chambers 30,31 are closed at either end. As the exhaust gas travels out of the exhaust device 4 and through the acoustical wind band 2, noise can be absorbed through the perforations in the surfaces of the outer walls into the acoustical fill material 32,33.

Figure 10A:
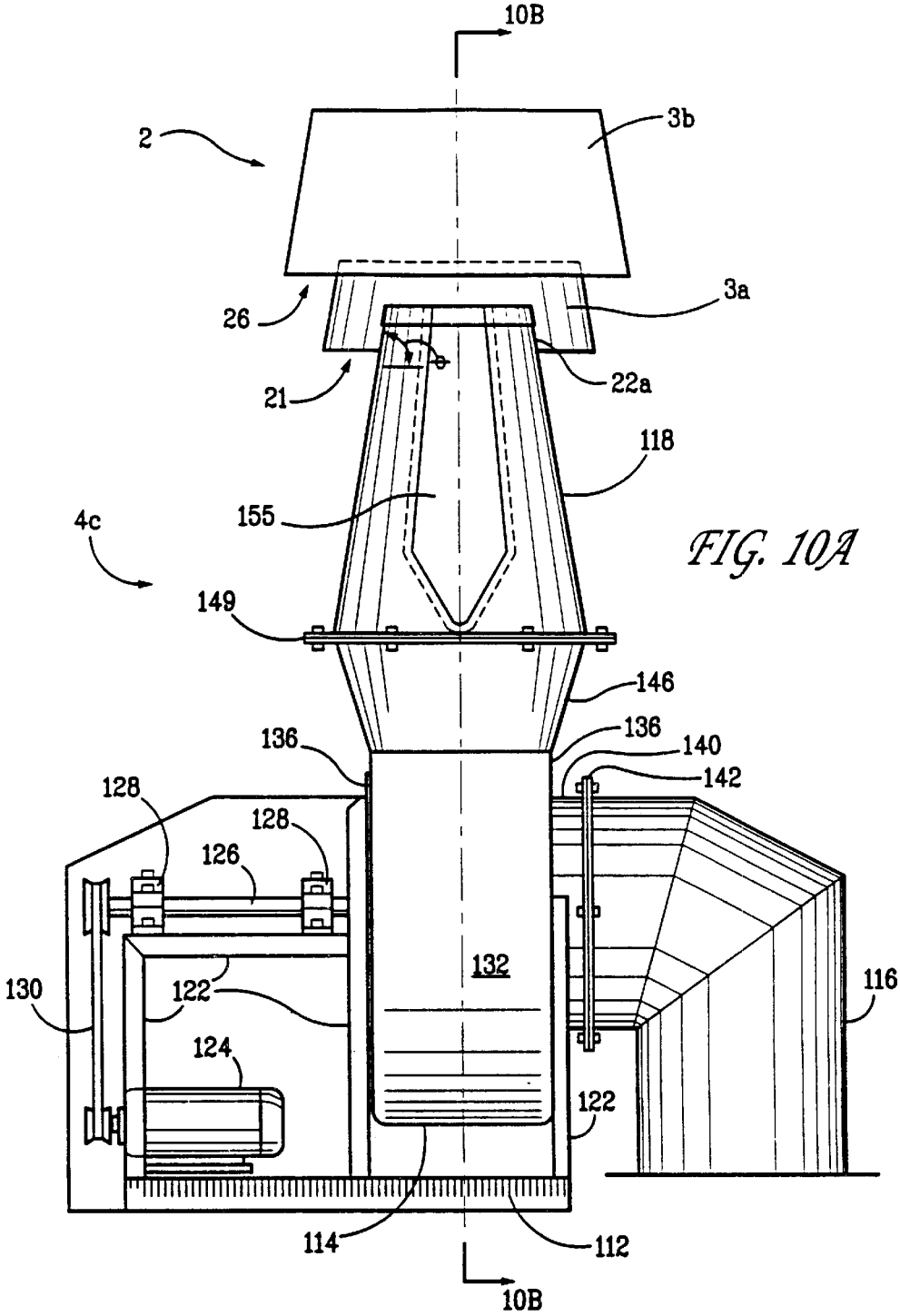
FIG. 10A is a front elevation of an exemplary acoustic silencer nozzle incorporated into another exhaust fan in accordance with the present invention.

As shown in FIG. 4, the exhaust device 4 can include any conventional gas exhaust device using conventional gas exhausting techniques, including an air moving device, a fan, a discharge nozzle, a stack, a silencer, a duct work discharge, a pipe, or the like. The gas exhaust device 4 can have a gas moving mechanism 34 to move a gas from an inlet 35 of the gas exhausting device 4 to a discharge 5 of the gas exhausting device 4. The gas moving mechanism 34 can include, for example, a fan, a nozzle, a pump, a vacuum, or the like, and is provided with a drive mechanism 36, such as for example a motor, that may be directly coupled to the fan or may be belt driven from either the inside of the exhaust device housing, as shown in FIGS. 4 and 7B, or from outside of the exhaust device housing, as shown in FIGS. 8 and 10A.

Figure 7B:
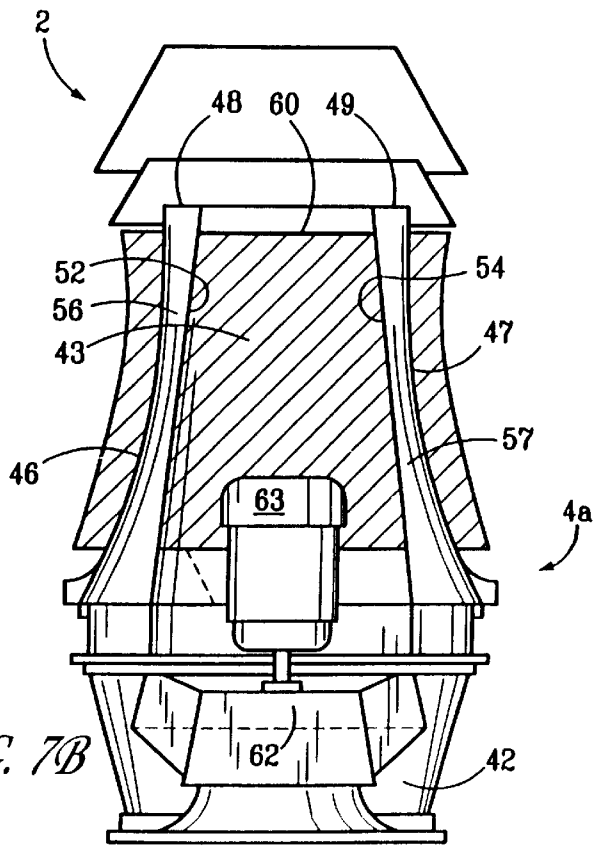
FIG. 7B is a side cross sectional view of the silencer nozzle of FIG. 7A taken along lines 3—3.
Figure 7A:
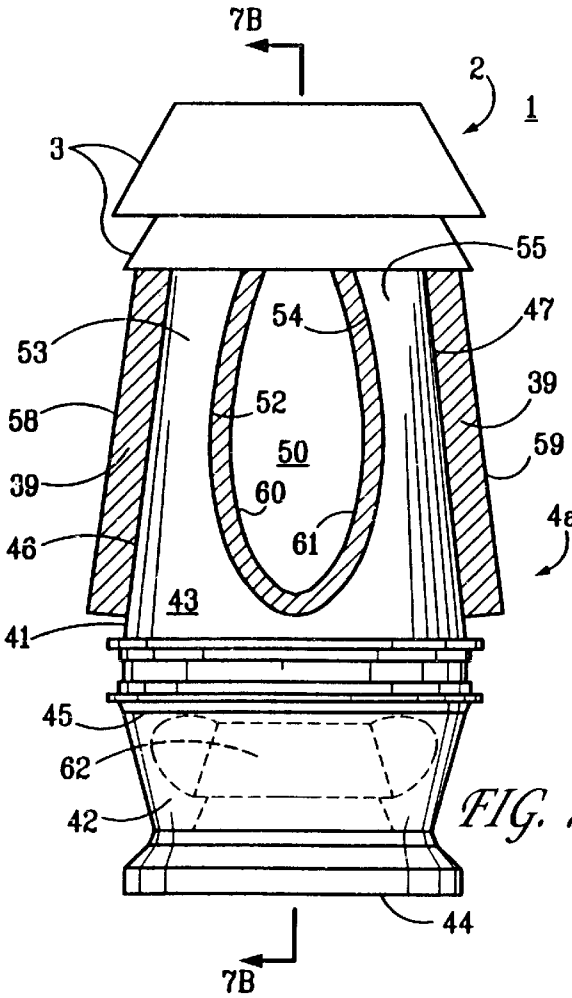
FIG. 7A is a plan view of another exemplary gas exhaust system having an acoustic wind band in accordance with the present invention.
Figure 8:
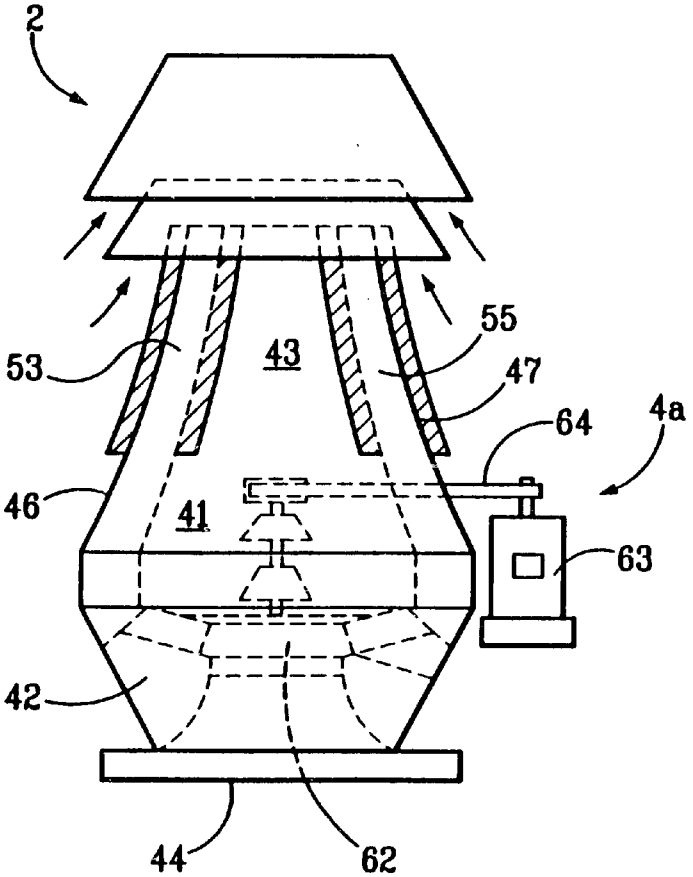
FIG. 8 is a front plan view of an alternative embodiment of the acoustic silencer nozzle of FIG. 7A showing a remotely positioned embodiment of a fan drive.

Referring to FIGS. 7A and 7B, shown is a first exemplary embodiment in accordance with the present invention including an acoustical wind band 2 having two or more wind band sections 3 disposed circumferentially and in spaced relation, as described in detail herein above, over and about one or more discharge outlets of an acoustic silencer nozzle having a radial upblast, mixed flow, centrifugal or axial exhaust fan, such as that described and shown in pending U.S. patent application entitled "Acoustic Silencer Nozzle", Ser. No. 09/390,796, filed Sep. 7, 1999, and is herein by incorporated in its entity by reference. This pending patent application describes a high velocity silencer nozzle for reducing the amount of noise generated by the exhausting gases as they exit through the exhausting device. As shown in FIGS. 7A and 7B, the acoustic silencer nozzle 4*a* provides acoustically absorbing media or resonating chambers 39 adjacent the converging exhaust paths 53,55 of the nozzle 43.

As shown in FIGS. 7A and 7B, the exhaust fan apparatus, such as a radial upblast, mixed flow, centrifugal, or axial exhaust fan, includes a main housing 41 having a fan housing 42 in the lower section thereof and acoustic silencer nozzle 43 positioned above the fan housing 42 and extending upwardly therefrom. The fan housing 42 defines a fan inlet 44 adapted to receive gases for exhausting thereabove and a fan outlet 45 for allowing movement of the gases upwardly from the fan housing 42 into the acoustic silencer nozzle 43. The acoustic silencer nozzle 43 defines a first outer wall section 46 and a second outer wall section 47 being generally conical sections and being concave, cylindrical, or straight with respect to one another. The acoustic silencer nozzle 43 further defines a first upper air outlet 48 and a second upper air outlet 49 at the uppermost portion thereof. A passive zone section defining a passive zone chamber 50 can be located between the first outer wall section 46 and the first upper air outlet 48 and the second outer wall section 47 and the second upper air outlet 49. The passive zone supplies air for mixing by induction into the contaminated air being exhausted through the two upper outlets.

The passive zone section 50 defines a first inner wall section 52 which can be shaped as a conical, cylindrical, or straight section being convex or straight facing outwardly toward the first outer wall section 46. A first exhaust flow path 53 is defined between the first inner wall section 52 and the first outer wall section 46. In a similar manner, the passive zone section 50 defines a second inner wall section 54 which can be shaped as a conical, cylindrical, or straight section and is convex facing outwardly and in spaced relation with respect to the second outer wall section 47 to define a second exhaust flow path 55 therebetween.

A first end wall 56, which may take the form of two end walls, may be positioned extending between the first inner wall section 52 and the first outer wall section 46. These end walls aid in the definition of the first exhaust flow path 53. In a similar manner, a second end wall 57, which may take the form of two second end walls, can be positioned extending from the second inner wall section 54 to the second outer wall section 47 to facilitate defining the second exhaust flow path 55.

First and second outer sheaths 58,59 can be disposed adjacent the section of the outer walls 46,47 and can comprise a perforated material. Similarly, inner sheaths 60,61 can be disposed adjacent a perforated sections on the inner walls 52,54, respectively. As the air travels down the exhaust flow paths 53,55, noise can be absorbed through the perforations in the surfaces of the outer walls 46,47 and the surfaces of the inner walls 52,54 into an acoustical fill material.

To facilitate the flow of air to be exhausted through the first and second exhaust flow paths, a fan 62 may preferably be positioned within the fan housing 42. The fan can be operatively connected with respect to a fan drive 63 to control operation thereof. The fan drive 63 may be positioned within the passive zone chamber 50, may be positioned externally from the main housing 41 of the exhaust device as shown in FIG. 8, or entirely below the nozzle section. In the configuration shown in FIG. 8, a belt drive 64 may be included positioned within the passive zone section 50 and may be operatively secured with respect to the drive 63 which itself may be secured with respect to the outer portion of the main housing 41.

As shown, the exhaust device can include one or more vertical flow paths and thus one or more upper contaminated air outlets (e.g., the exhaust gas outlet or outlet portions). FIGS. 7A and 7B show one on one side and one on another with a passive zone therebetween. Each of these can be divided into multiple sections such that any number of individual upper flow paths can be defined positioned circumferentially about the passive zone.

During operation of the exhaust device, a primary stream of fluid (e.g., exhaust gas) can move at a velocity of, for example, at least about 2000 ft/min (with respect to the ambient fluid in the atmosphere), and preferably up to about 6600 ft/min. The movement of the primary stream of fluid sets up aspiration in such a manner so that two or more secondary streams or flows of fluid are drawn from the ambient fluid (e.g., air) of the atmosphere.

It should be noted that the exhaust paths 53,55 preferably converge in order to keep the exhaust plume tight, which can create a current of air on the order of, for example, about 110 feet in diameter moving at about 250 ft/min in still air. This helps to dilute effluent or fumes prior to release into the atmosphere, thus effectively minimizing pollution problems with extremely high efficiency.

Another exemplary embodiment in accordance with the present invention is shown in FIG. 9. As shown in FIG. 9, the acoustical wind band 2 can be disposed circumferentially and in spaced relation about one or more discharge outlets 5 of an exhaust fan apparatus 4*b*, such as a radial upblast, mixed flow, centrifugal or axial exhaust fan, such as the exhaust fan apparatus described and shown in U.S. Pat. No. 4,806,076 issued Feb. 21, 1989 to Andrews, which is herein by incorporated by reference in its entirety. U.S. Pat. No. 4,806,076 describes an exhaust nozzle in which two converging flow paths are defined by two respective passageways 23,24. The exhaust fan apparatus 4b includes a main housing 65 having a fan housing 66 and a nozzle 67. A fan means (not shown) can be positioned within the fan housing to urge exhaust gases to flow upwardly through one or more exhaust paths (not shown) formed in the nozzle 67. A passive zone 68 located between the two flow paths can supply environmental air for mixing by induction into the contaminated gases being exhausted through the converging flow paths.

Figure 10B:
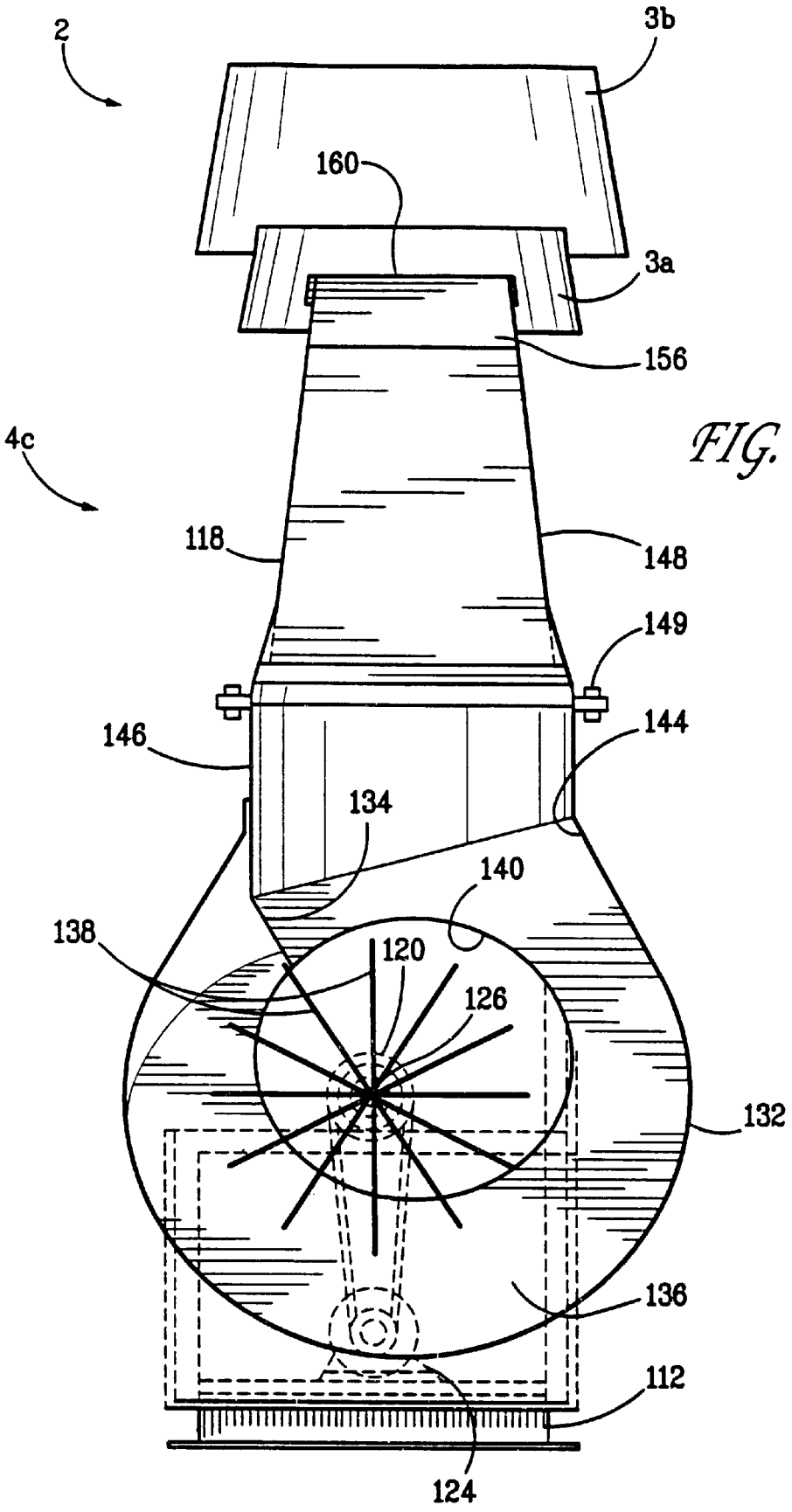
FIG. 10B is a vertical cross section taken along line 9—9 of FIG. 10A.

Another exemplary embodiment in accordance with the present invention is shown in FIGS. 10A and 10B. As shown in FIGS. 10A and 10B, the acoustical wind band 2 can be disposed circumferentially and in spaced relation about one or more discharge outlets of an exhaust fan apparatus 4*c*, such as a centrifugal fan scrolling casing, with a centrifugal fan impeller mounted on an axle within the casing and having an axis of rotation at right angels to the side members of the scroll casing as described and shown in U.S. Pat. No. 5,439,349, issued Aug. 8, 1995 to Kupferberg, which is herein by incorporated in its entity by reference. U.S. Pat. No. 5,439,349 describes an apparatus 4*c* having a base 112 meant to be mounted on a roof, a centrifugal fan casing 114 mounted on the base 112, and an inlet duct 116 extending to one side of the casing 114 from the interior of a building (not shown). Mounted to the top of the centrifugal fan casing 114 is an exhaust stack or nozzle 118, and topping the exhaust stack is an acoustical wind ban 2 having a frusto-conical shape.

The base 112 includes a frame 122 on which a motor 124 is mounted. A shaft 126 is journaled in bearing brackets 128 mounted on the frame 122 and extends within the casing 132 in a cantilevered manner. The shaft 126 is driven by a drive belt 130 taken off the motor 124. As shown in FIG. 10A, shaft 126 mounts a centrifugal impeller 138 having multiple vanes rotating about the axis of the shaft 126.

The casing 114 includes a scroll 132 surrounding the impeller 138 and interrupted by discharge port 144. The scroll 132 includes a cut-off 134 near the discharge port 144. The casing 114 also includes parallel side walls 136. An inlet port 140 is defined on one side wall 136 of the casing 114, and connector flanges 142 are provided to fasten the inlet port 140 with the inlet duct 116.

Thus, the spent gases containing airborne contaminants exhausting from the building through the duct 116 enter the casing 114 axially relative to the impeller 138, and the air flow is accelerated through the discharge port 144. A diffuser tube 146 is mounted to and communicates with the discharge port 144. The diffuser tube 146 is in turn connected to the bifurcated duct 148 by means of connecting flanges 149. The bifurcated duct 148 includes passageways 150 and 152 which are generally parallel although they, in fact, converge slightly toward the outlet. A central opening 155 is formed by means of inner flat walls 154 and 156 defining the passageways 150 and 152 respectively.

In operation, the impeller 138, driven by motor 124, will draw the exhaust gases from the building containing airborne contaminants through the duct 116 and then upwardly into the stack or nozzle 118 by first passing through the diffuser and then the double passageways 150 and 152. The location of the casing 114 and, in particular, the orientation of the scroll 132 relative to the stack or nozzle 118, permits even distribution of the air flow into the diffuser and through the passageways 150 and 152. The spent gases exhaust through the outlet ports 158 and 160 at relatively high velocity and cause ambient air to be induced into the annulus or passages 21,26 of the acoustical wind band apparatus 2 to mix with the airborne contaminants and, therefore, dilute the exhaust.

The gas exhaust system 1 is preferably constructed to accommodate various types of gases. For purposes of clarity, gas or exhaust gas, as used herein, is intended to encompass any medium which may be emitted through an exhaust device outlet, including but not limited to one or more gases, air, smoke, dust, fumes, air bourne particles, fluid vapors, or the like.

In addition, it is contemplated by the present invention that a spacer, piping, duct work, or the like can be positioned between the discharge of the exhaust device and the acoustical wind band. The acoustical wind band can be used on an exhaust device having a diverging, a straight, and a converging discharge flow of exhaust gas.

Exemplary Air Flows During Operation

FIG. 11 is a schematic view showing exemplary flows for the exhaust gas and entrainment of the ambient environmental air. As shown in FIG. 11, a primary exhaust gas flow 70 flows upward from, for example a fan discharge, and into one or more gas paths formed in, for example, a silencer nozzle. The nozzle increases the velocity of the exhaust gas as it exits one or more outlet portions of the nozzle and enters the acoustical wind band apparatus position above and about the discharge of the exhaust device.

The nozzle may include a passive zone chamber for the introduction of a flow of primary ambient environmental air with the discharging exhaust gas at the discharge of the exhaust device. The passive zone supplies air as shown by arrow 71 for mixing by induction into the contaminated air being exhausted through the two upper outlets. Air will also be induced to flow from the passive zone chamber upwardly as shown by arrow 71 into the contaminated gases being exhausted through the two upper outlets to facilitate mixing therewith. Preferably, the primary ambient air mixes with the exhausting air immediately upon movement of the exhausting gases outwardly through the upper outlet portions of the exhaust device discharge.

The acoustical wind band 2 acts to improve the air entrainment properties of the exhaust device by providing two or more secondary flows of ambient environmental air through the two or more passages formed by the acoustical wind band. In this manner, when gases are exhausted through the discharge of the exhaust device, two or more flows of secondary ambient environmental air will be induced by the acoustical wind band to flow as shown in FIG. 11 by arrows 72 and 73. Preferably, the secondary ambient air mixes with the exhausting air within the acoustical wind band upon movement of the exhausting gases upwardly through the acoustical wind band from the exhaust device discharge. The flow of the primary flow of ambient environmental air 71 and the secondary flows of ambient environmental air 72,73 mix with the exhaust gas flow 70 and form a high velocity discharge of diluted exhaust gas as indicated by arrow 74 exiting the top of the acoustical wind band. The wind band 2 also protects the vena contracta produced by the converging flow (plume) from the primary exhaust passageway.

Although illustrated and described herein with reference to certain specific embodiments, it will be understood by those skilled in the art that the invention is not limited to the embodiments specifically disclosed herein. Those skilled in the art also will appreciate that many other variations of the specific embodiments described herein are intended to be within the scope of the invention as defined by the following claims.

What is claimed is:

1. An acoustic wind band apparatus for use with a gas exhaust device having a discharge outlet portion for exhausting a primary flow of high velocity gas in a gas exhaust system comprising:

a plurality of spaced apart wind band sections, each wind band section having a top end defining a top opening, a bottom end defining a bottom opening, and one or more side walls disposed between and connecting said top end to said bottom end;

said plurality of wind band sections being disposed circumferentially and in vertical spaced relation over said discharge outlet portion of said gas exhaust device and extending generally upward therefrom;

wherein each wind band section has a smallest diameter or width greater than a diameter or width of said discharge outlet portion;

a plurality of passages formed around a peripheral of said acoustic wind band and disposed circumferentially about said discharge outlet portion, wherein each passage draws a flow of gas from environmental atmosphere outside said acoustic wind band to induce a flow of environmental gas from therebelow to mix with and dilute gas from said discharge outlet portion inside said acoustic wind band; and a wind band top opening formed by said top end of an upper most wind band section through which a high velocity exhaust flume comprising said exhaust gas from said discharge outlet portion and said flow of environmental gas exits.

2. The acoustic wind band apparatus of claim 1, wherein a number of said plurality of passages corresponds to a number of said plurality of wind band sections.

3. The acoustic wind band apparatus of claim 1, further comprising at least a first passage formed between one of a top wall and a side wall of said exhaust device and said side wall of a first, lower most wind band section, and at least a second passage formed between a second wind band section side wall and said first wind band side wall.

4. The acoustic wind band apparatus of claim 1, wherein said bottom end of a first, lowest most, wind band section extends at least to a horizontal plane defined by a line of sight of said discharge outlet portion, and wherein said bottom end of each vertically successive wind band section extends at least to a horizontal plane defined by said top end of a vertically preceding wind band section.

5. The acoustic wind band apparatus of claim 1, wherein each of said sections further comprises one of a cylindrical shape, a straight conical shape, a curved conical shape, a square shape, and a rectangular shape.

6. The acoustic wind band apparatus of claim 1, wherein said bottom opening and said top opening are aligned about a vertical centerline of said acoustic wind band and comprise one of a circular shape, a square shape, and a rectangular shape.

7. The acoustic wind band apparatus of claim 1, wherein said side walls of adjacent sections of said plurality of wind band sections are parallel with respect to one another.

8. The acoustic wind band apparatus of claim 1, wherein said first, lowest most, wind band section is positioned over and about said discharge portion and each vertically successive section is larger than said preceding section and each vertically successive section is positioned over and about said preceding section.

9. The acoustic wind band apparatus of claim 1, wherein said first, lowest most, wind band section is positioned over and about said discharge portion and each vertically successive section is smaller than said preceding section and each vertically successive section is positioned over and within said preceding section.

10. The acoustic wind band apparatus of claim 1, further comprising support structures disposed between and connection said acoustic wind band to said exhaust device and for holding said plurality of wind band sections in spaced apart relation with respect to one another.

11. The acoustic wind band apparatus of claim 10, wherein said support structure further comprising a plurality of wind band brackets attached with respect to said exhaust device and attached with respect to each of said sections of said acoustic wind band for retaining said acoustic wind band on said exhaust device and for holding said sections in spaced relation with respect to said exhaust device and with respect to adjacent sections.

12. The acoustic wind band apparatus of claim 1, wherein said plurality of wind band sections comprises two wind band sections, and wherein said two wind band sections comprise an inner, lower section and an outer, upper section.

13. The acoustic wind band apparatus of claim 12, wherein:

said inner, lower section is disposed circumferentially and in spaced relation over and about said discharge outlet portion of said gas exhaust device and extends generally upward therefrom, wherein said bottom end of said inner section extends beyond a horizontal plane defined by a line of sight of said discharge outlet portion; and said outer, upper section is disposed circumferentially and in spaced relation over and about said inner, lower section and said side wall extending generally upward therefrom, wherein said bottom end of said outer, upper section extends beyond a horizontal plane defined by said top end of said inner, lower section.

14. The acoustic wind band apparatus of claim 12, further comprising:

a first passage formed between said inner, lower section and one of a top wall and a side wall of said gas exhaust device, wherein said first passage draws a first flow of gas from environmental atmosphere outside said acoustic wind band to induce a flow of said environmental gas from therebelow to mix with and dilute gas from said discharge outlet portion inside said acoustic wind band; and a second passage formed between said inner, lower section and said outer, upper section, wherein said second passage draws a second flow of gas from environmental atmosphere outside said acoustic wind band to induce a further flow of environmental gas from therebelow to further mix with and dilute gas from said discharge outlet portion inside said acoustic wind band.

15. The acoustic wind band apparatus of claim 1, wherein one of a top wall and a side wall of said exhaust device extends upward and inward to forms a first angle, a lower section side wall extends generally upward and inward to form a second angle, and an upper section side wall extends generally upward and inward to form a third angle, wherein said first angle is formed between a plane defined by a horizontal plane and one of said top wall and said side wall of said exhaust device, said second angle is formed between a horizontal plane defined by said bottom end of said lower section and said lower section side wall, and said third angle is formed between a horizontal plane defined by said bottom end of said upper section and said upper section side wall.

16. The acoustic wind band apparatus of claim 15, wherein said second angle and said third angle are formed as acoustically reflecting angled sections to reflect noise inward and upward to improve sound attenuation, and said angles increase a velocity of said ambient environmental air entering said acoustic wind band.

17. The acoustic wind band apparatus of claim 15, wherein said second angle and said third angle are formed at an angle between about 60 degrees and about 90 degrees from horizontal.

18. The acoustic windband apparatus of claim 15, wherein said side walls of said plurality of wind band sections are formed having different angles from one another.

19. A gas exhaust system having an acoustic wind band for exhausting a gas or fluid flowing at a high velocity from a building or room comprising:

a gas exhausting device for exhausting a gas or fluid from an interior of a building to atmosphere, said gas exhausting device comprising:

a fan for inducing a flow of said gas from an inlet opening of said gas exhaust device to an outlet open of said gas exhaust device;

a nozzle positioned above said fan and being in fluid communication with said fan to receive exhaust gas therefrom for expelling said gas to atmosphere;

wherein one or more primary exhaust flow paths are formed in said gas exhaust device, said one or more primary exhaust flow paths being adapted to receive exhaust gases and guide said exhaust gases to release upwardly though a discharge outlet portion formed proximate said gas outlet opening;

an acoustic wind band connected to said gas exhausting device, said acoustic wind band comprising:

a plurality of spaced apart wind band sections, each wind band section having a top end defining a top opening, a bottom end defining a bottom opening, and a side wall disposed between and connecting said top end to said bottom end;

said plurality of wind band sections being disposed circumferentially around and in vertical spaced relation over said discharge outlet portion of said gas exhaust device and extending generally upward therefrom;

wherein each wind band section has a height defined by the vertical distance between said bottom end and said top end, and wherein each vertically successive wind band section has a height that is greater than said height of a first lower most wind band section; and a plurality of passages formed around a peripheral of said acoustic wind band and disposed circumferentially about said discharge outlet portion, wherein each passage draws a secondary flow of gas from environmental atmosphere outside said acoustic wind band to induce said secondary flow of environmental gas from therebelow to mix with and dilute said primary flow of exhaust gas from said discharge outlet portion inside said acoustic wind band;

an opening formed by said top ends of said wind band sections concentrically with an axis of said discharge outlet portion of said exhaust device through which a high velocity exhaust flume comprising a mixture of said primary flow of exhaust gas from said discharge outlet portion and said secondary flow of environmental gas exits vertically upward.

20. The gas exhaust system of claim 19, wherein said flow of gas or fluid exiting said one or more exhaust flow paths and passing through said acoustic wind band sets up aspiration in such a manner so that said flow of environmental gas is drawn from ambient atmosphere through said passages.

21. The gas exhaust system of claim 19, wherein said bottom end of a first, lowest most, wind band section extends at least to a horizontal plane defined by a line of sight of said discharge outlet portion, and wherein said bottom end each vertically successive wind band section extends at least to a horizontal plane defined by said top end of a vertically preceding wind band section.

22. The gas exhaust system of claim 19, wherein each of said sections further comprises one of a cylindrical shape, a straight conical shape, and a curved conical shape, and wherein said side walls of said plurality of wind band sections are disposed generally parallel relation with respect to one another.

23. The acoustic wind band apparatus of claim 19, wherein said first, lowest most, wind band section is positioned over and about said discharge portion and each vertically successive section is larger than said preceding section and each vertically successive section is positioned over and about said preceding section.

24. The gas exhaust system of claim 19, further comprising an acoustic wind band support structure disposed between and connection said acoustic wind band to said exhaust device and for holding said plurality of wind band sections in spaced apart relation with respect to one another.

25. The acoustic wind band apparatus of claim 24; wherein said support structure further comprising a plurality of wind band brackets secured with respect to said exhaust device and attached with respect to each of said sections of said acoustic wind band for retaining said acoustic wind band on said exhaust device and for holding said sections in spaced relation to said exhaust device and with respect to adjacent sections.

26. The gas exhaust system of claim 19, wherein one of a top wall and a side wall of said exhaust device extends upward and inward to forms a first angle, a side wall of a lower most wind band section extends generally upward and inward to form a second angle, and a side wall of an upper side wall extends generally upward and inward to form a third angle, wherein said first angle is formed between a plane defined by a horizontal plane and one of said top wall and said side wall of said exhaust device housing, said second angle is formed between a horizontal plane defined by said bottom end of said lower section and said lower section side wall, and said third angle is formed between a horizontal plane defined by said bottom end of said upper section and said upper section side wall.

27. A method for improving sound attenuation sound in a gas exhaust system using an acoustic wind band, said method comprising.

providing a gas exhaust device having a gas inlet opening for receiving a gas to be exhausted and a gas outlet opening for discharging said gas to atmosphere;

disposing an acoustic wind band having a plurality of vertically spaced apart wind band sections over and about said exhaust gas outlet of said exhaust device;

positioning a first, lower wind band section such that at least a portion of a bottom end of said lower wind band section blocks a direct line of sight from a point outside said exhaust device and said lower wind band section from a point inside said exhaust device and said lower wind band section;

positioning each vertically successive wind band section having a height that is greater than said first, lower most wind band section such that at least a portion of a bottom end of a vertically successive wind band section blocks a direct line of sight between a point outside a vertically preceding wind band section and said successive wind band section and a point inside said preceding wind band section and said successive wind band section; and blocking noise generated by said exhaust device and said exhaust gas outlet opening from radiating along a direct line of sight from a point inside said acoustic wind band and said exhaust device to a point outside said acoustic wind band and said exhaust device.

28. The method according to claim 27, further comprising forming each of said wind band sections extending upward and inward to form an angle inclined toward an upper, center region of said acoustic wind band, wherein said angles act to reflect noise inward and upward through said acoustic wind band.

29. A method for improving the discharge velocity and thereby the effective stack height of a gas exhaust device in a gas exhaust system using an acoustic wind band, said method comprising:

providing a gas exhaust device having a gas inlet opening for receiving a gas to be exhausted, a high velocity discharge nozzle, and a gas outlet opening for discharging a primary flow of said gas to atmosphere;

disposing an acoustic wind band having a plurality of vertically spaced apart wind band sections over and about said exhaust gas outlet of said exhaust device;

forming a plurality of passages for drawing ambient environmental air from a point outside said acoustic wind band to a point inside said acoustic wind band, wherein a number of said plurality of passages corresponds to a number of said plurality of wind band sections, and wherein a first passage is formed between a housing of said gas exhaust device and an inner surface of said lower wind band section and each successive passage is formed between an outer surface of a preceding wind band section and an inner surface of a successive wind band section; and inducing a plurality of secondary flows of ambient environmental air through said plurality of passages to be mixed with and dilute said primary flow of exhaust gas discharging from said gas outlet opening of said gas exhaust device.

30. The method according to claim 29, further comprising forming each of said wind band sections extending upward and inward to form an angle inclined toward an upper, center region of said acoustic wind band, wherein said angles act to increase one or more of a velocity and a volume of said exhaust gas flowing through said acoustic wind band.

31. The exhaust gas system of claim 19, wherein said one or more exhaust flow paths further comprises a primary stream of exhaust gas exiting said nozzle and having a velocity of at least about 2000 feet per minute, wherein said primary stream of exhaust gas set up aspiration as it passes through an open center region of said acoustic wind band so that converging, secondary streams of air drawn from ambient air of the atmosphere through each of said plurality of passages of said wind band, where said secondary streams mix with and dilute said primary stream of exhaust gas resulting in an increase in an effective stack height of a tight exhaust plume formed by said primary stream and said secondary streams.

32. The acoustic wind band apparatus of claim 1, wherein said plurality of wind band sections further comprises a first, lower most wind band section having a first height defined by a vertical distance between said bottom end and said top end of said first, lower most wind band section and at least a second, vertically successive wind band section having a height defined by a vertical distance between said bottom end and said top end of said at least a second vertically successive wind band section, wherein said height of each of said at least a second vertically successive wind band section is greater than said height of said first, lowermost wind band section.

33. The method according to claim 27, further comprising disposing one or more of a sound reflecting and a sound absorbing material over at least a portion of an inner surface of a sidewall of one or more of said plurality of wind band sections.

* * * * *